US011998824B1

(12) United States Patent
Hamburger

(10) Patent No.: US 11,998,824 B1
(45) Date of Patent: Jun. 4, 2024

(54) GOLF CLUB ALIGNMENT DEVICE

(71) Applicant: Edward Hamburger, Toms River, NJ (US)

(72) Inventor: Edward Hamburger, Toms River, NJ (US)

( * ) Notice: Subject to any disclaimer, the term of this patent is extended or adjusted under 35 U.S.C. 154(b) by 0 days.

(21) Appl. No.: 18/545,224

(22) Filed: Dec. 19, 2023

Related U.S. Application Data

(62) Division of application No. 18/210,691, filed on Jun. 16, 2023, now abandoned.

(60) Provisional application No. 63/460,922, filed on Apr. 21, 2023.

(51) Int. Cl.
*A63B 69/36* (2006.01)

(52) U.S. Cl.
CPC ..... *A63B 69/3685* (2013.01)

(58) Field of Classification Search
CPC ..... A63B 69/3685
USPC ..... 473/206, 226–238, 266–269
See application file for complete search history.

(56) References Cited

U.S. PATENT DOCUMENTS 3,758,117 A * 9/1973 Harrison ..... A63B 69/3632 473/238
4,174,838 A * 11/1979 Paschetto ..... A63B 69/3685 473/238
4,603,893 A * 8/1986 Takahashi ..... F16L 21/06 285/342
4,647,045 A * 3/1987 Bilyeu ..... A63B 69/3685 473/238
5,605,509 A * 2/1997 Gray ..... A63B 69/3632 473/238
5,762,564 A * 6/1998 Schang ..... A63B 69/3685 473/238
7,059,970 B1 * 6/2006 Hamburger ..... A63B 69/3685 473/226
7,063,625 B2 * 6/2006 Murtha ..... G01C 9/26 473/251
7,588,500 B2 * 9/2009 Hoeckl ..... A63B 69/3638 473/226
9,333,408 B1 * 5/2016 Hedrick ..... A63B 69/3632

* cited by examiner

*Primary Examiner* — Nini F Legesse
(74) *Attorney, Agent, or Firm* — MacMillan, Sobanski & Todd, LLC

(57) ABSTRACT

Golf club alignment devices are described herein. An example golf club alignment device includes an attachment portion and a sighting structure. The attachment portion has a main body and a contact member. The main body is formed of a first material and the contact member is formed of a second material that is different than the first material. The main body has a first retaining arm and a second retaining arm. The contact member extends outwardly from the main body of the attachment portion and is disposed between the first and second retaining arms. The sighting structure extends from the attachment portion.

20 Claims, 10 Drawing Sheets

GOLF CLUB ALIGNMENT DEVICE

CROSS-REFERENCE TO RELATED APPLICATIONS

This application is a divisional patent application of U.S. patent application Ser. No. 18/210,691, filed Jun. 16, 2023. U.S. patent application Ser. No. 18/210,691 claims the benefit of U.S. Provisional Application No. 63/460,922, filed Apr. 21, 2023, the disclosures of these applications are incorporated herein by reference in their entirety.

FIELD

The disclosure relates generally to the field of golf equipment. More particularly, the disclosure relates to a golf club alignment device that includes a contact member for stabilizing the alignment device relative to a golf club.

BACKGROUND

When striking a golf ball, it is important to correctly align the striking face of the golf club with the intended travel direction of the ball. In order to correctly hit or strike the ball in the intended direction, the striking face of the golf club must be positioned at a normal angle relative to the intended travel direction of the ball. If the striking face of the golf club is not normal to the intended travel direction of the ball, the club will strike the ball at a non-perpendicular angle, thereby propelling the ball to the left or right of the intended travel direction. As the user swings the club, such as a putter, the head of the golf club swings in an arcuate path. The arcuate path lies generally in a vertically orienting plane. Preferably, the generally flat striking surface of the putter is perpendicular with the plane upon impact with the ball.

Alignment devices have been developed that aid the user in properly orienting the striking face of the club relative to the intended travel direction of the ball. Some of these devices are attached to the shaft of the club. In one such known device, as is disclosed in U.S. Pat. No. 3,951,415, a golf putter sighting device is resiliently clamped to the shaft of the club. The sighting device includes a pair of spaced apart sights, such as colored beads, which extend outwardly from an elongated main body portion of the sighting device. When properly attached to a putter shaft, each pair of sights are exposed when the user looks downwardly at the shaft. Thus, as the user looks downwardly at the shaft and sighting device, the main body portion is covered or hidden by the shaft but the sights are visible from the sides of the shaft. During swinging of the club, the user aligns the device such that the pair of sights are equally visible upon impact of the ball, thereby properly aligning the striking face of the club at a perpendicular direction with respect to the intended travel direction of the ball. However, maintaining or observing equally visible sights is typically difficult for most golfers. Also, the highly decorative color of the sights is often distracting to the golfer during the swing. Since the spaced apart sights are permanently at a set space or width apart, golfers of differing heights will not see the same visual indicators. For example, for taller golfers, the sights may not be spaced sufficiently apart from one another to see completely at the edges of the shaft.

In another example, U.S. Pat. No. 7,059,970 is the applicant's previous iteration of an alignment device to overcome the noted visual orientation limitations of the prior art. While this alignment device provides a sighting advantage over the prior art, unintended movements of the device relative to the golf club during use, limit proper use of the alignment device and achieving a proper swing. Since the materials used to construct previous alignment devices are typically rigid, in order to maintain relative positions of components during a swing event, these materials often exhibit coefficients of friction that readily slip relative to steel or composite golf shaft materials.

Thus, there exists a need for new and useful golf club alignment device that can be positioned and reliably remain in that position during use.

SUMMARY OF SELECTED EXAMPLE EMBODIMENTS

Various golf club alignment devices are described herein.

An example embodiment of a golf club alignment device includes an attachment portion and a sighting structure. The attachment portion has a main body and a contact member. The main body is formed of a first material and the contact member is formed of a second material that is different than the first material. The main body has a first retaining arm and a second retaining arm. The contact member extends outwardly from the main body of the attachment portion and is disposed between the first and second retaining arms. The sighting structure extends from the attachment portion.

An example embodiment of a golf club and alignment device includes a golf club and an alignment device. The golf club has a shaft. The shaft has an end and a head that extends from the end of the shaft in a first direction. The alignment device includes an attachment portion and a sighting structure. The attachment portion is attached to the shaft and has a main body and a contact member. The main body is formed of a first material and defines a first retaining arm and a second retaining arm. The first and second retaining arms cooperatively define a cavity. The contact member is formed of a second material that is different than the first material. The contact member extends outwardly from the main body of the attachment portion and into the cavity. The sighting structure extends from the attachment portion in a second direction that is generally opposite to the first direction.

Another example embodiment of a golf club and alignment device includes a golf club and an alignment device. The golf club has a shaft. The shaft has an end and a head that extends from the end of the shaft in a first direction. The attachment portion is attached to the shaft and has a main body and a contact member. The main body is formed of a first material and defines a first retaining arm and a second retaining arm. The first and second retaining arms cooperatively define a cavity. The contact member is an elongate member and is formed of a second material that is different than the first material. The contact member extends outwardly from the main body of the attachment portion and into the cavity. The sighting structure extends from the attachment portion in a second direction that is generally opposite to the first direction. The sighting structure is hidden by the shaft when viewed by a user gripping the golf club to address a ball.

Additional understanding of the exemplary golf club alignment devices can be obtained by review of the detailed description, below, and the appended drawings.

DETAILED DESCRIPTION

The following detailed description and the appended drawings describe and illustrate various example embodiments of golf club alignment devices. The description and illustration of these examples are provided to enable one skilled in the art to make and use a golf cub alignment device. They are not intended to limit the scope of the claims in any manner. The invention is capable of being practiced or carried out in various ways and the examples described and illustrated herein are merely selected examples of the various ways of practicing or carrying out the invention and are not considered exhaustive.

Figure 1:
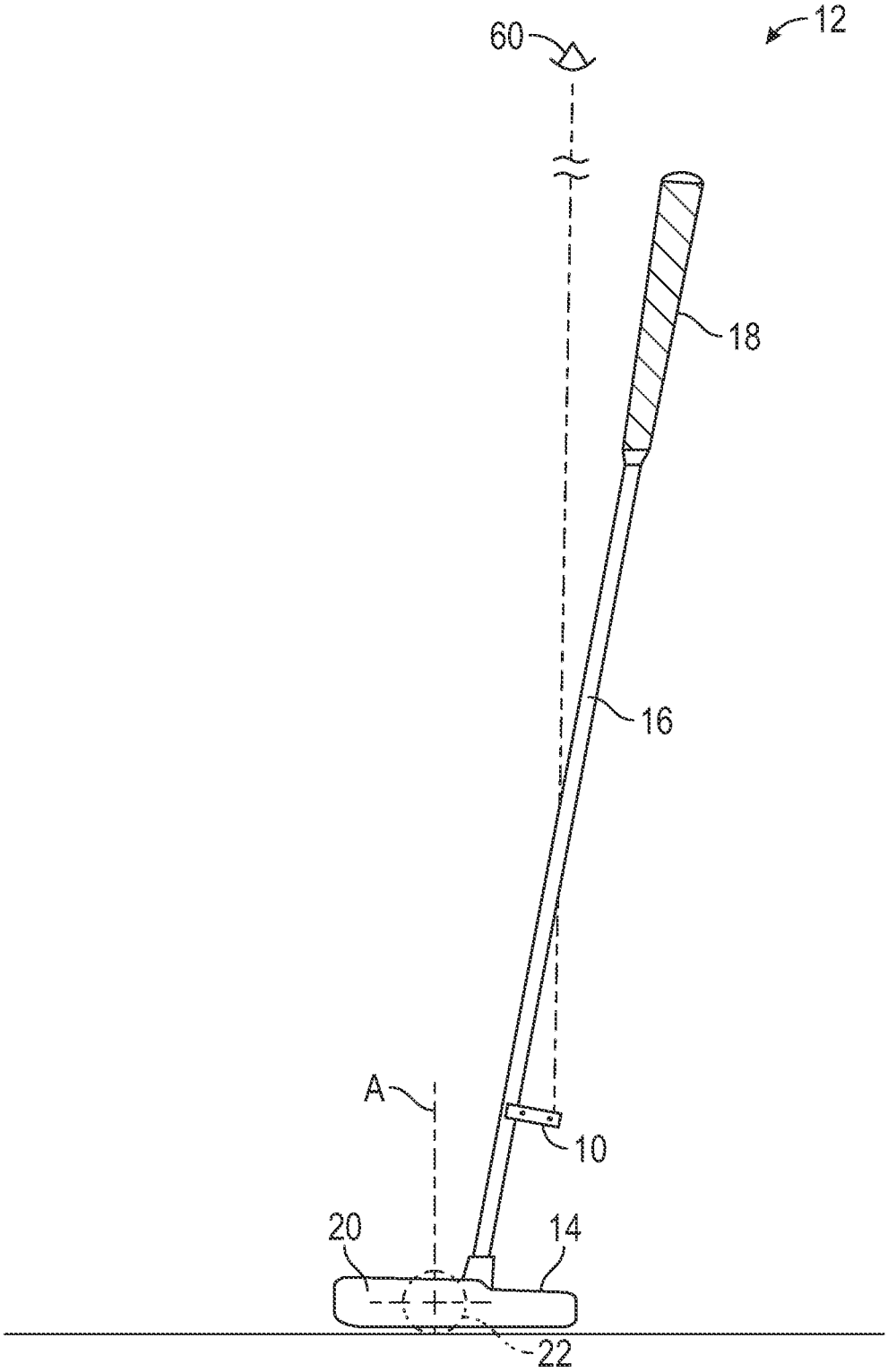
FIG. 1 is a schematic side elevational view of a golf club that includes an example alignment device attached to the shaft of the club.

FIG. 1 illustrates an alignment device 10, according to an embodiment, attached to a golf club 12. As will be discussed in detail below, the alignment device 10 is attachable to, and removable from, the golf club 12 for aiding a golfer or user of the club 12 to properly align the striking face of a golf club with the intended travel path of the ball.

It should be understood that the alignment device 10 can be used with any style of golf club, and is illustrated and described herein as being used in cooperation with a putter style golf club. The club or putter 12 generally includes a head 14, a shaft 16, and a grip or handle 18. The head 14 includes a generally flat planar striking face 20 for engaging with a golf ball 22. The striking face may be oriented in a generally vertical plane, such as is typical for a putter, or may be at an angle relative to a vertical plane, which is typical for iron and wood type clubs.

To strike the ball 22, the user swings the head 14 in an arcuate path such that head will travel a greater distance than the handle 18, since the user grips the club 12 by the handle 18. In a generally properly swung club, the arcuate path of the head 14 lies in a generally vertical plane, generally indicated at A in FIGS. 1 and 5. This arcuate path also represents the desired travel direction of the ball which the user wishes the ball to travel. As will be discussed below it is important for the user to align the striking face 20 of the head 14 with the intended travel direction A of the ball 22.

Figure 2:
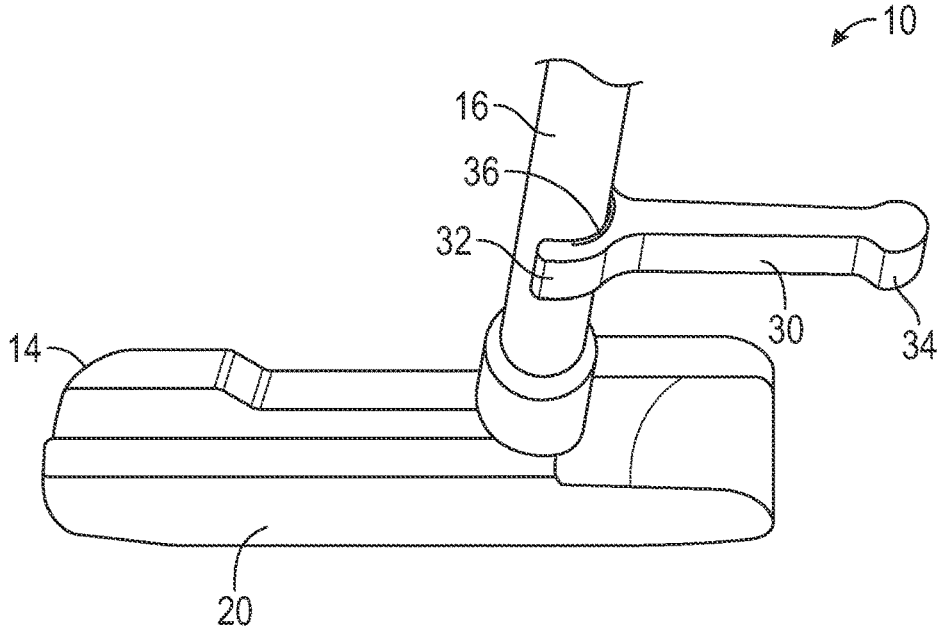
FIG. 2 is a partial enlarged perspective view of the alignment device shown in FIG. 1 attached on the lower portion of the shaft of the club.
Figure 3:
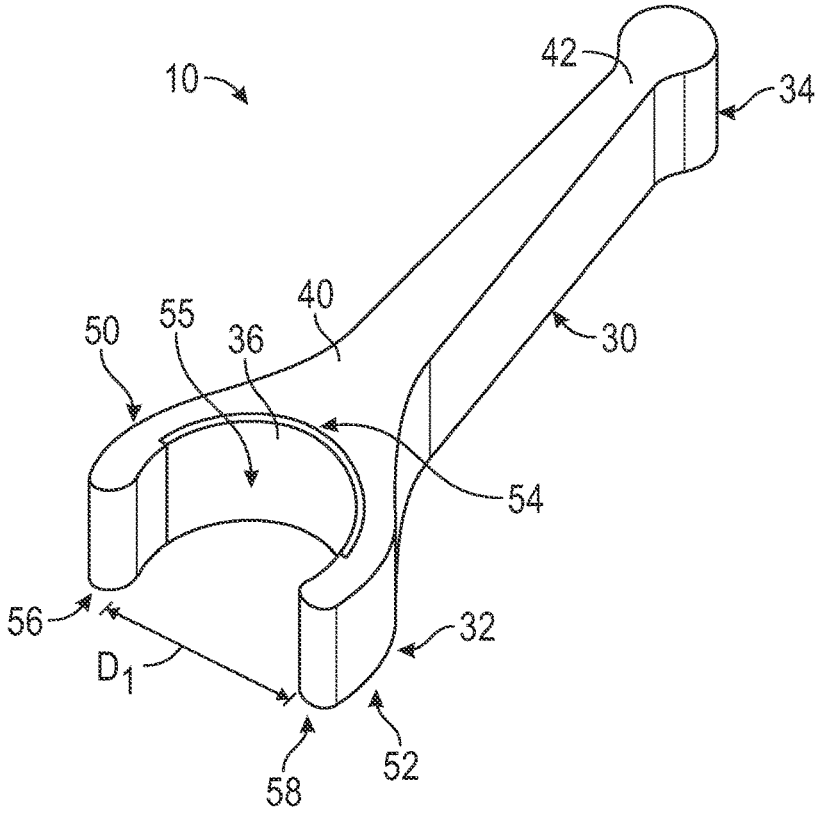
FIG. 3 is an enlarged perspective view of the alignment device shown in FIGS. 1 and 2.

An embodiment of the alignment device 10 is illustrated in FIGS. 1 through 6. As best shown in FIGS. 2 and 3, the alignment device 10 includes a main body 30, an attachment portion 32, and a sighting structure 34. Preferably, the main body 30, the attachment portion 32, and the sighting structure 34 are all integrally formed together as a single unit, although such is not required. The alignment device may be made of any suitable material such as, for example, a plastic, composite material, fiber reinforced plastic, or a lightweight metal such as aluminum, titanium, or magnesium. Alternatively, the alignment device may be a mixed material structure where the attachment portion is made from a first material such as, for example, a plastic or thin-wall thickness formed spring steel, and the main body formed from a second material such as a lightweight metal or a second plastic material. Preferably, the material of the alignment device 10, or at least the main body portion has a rigidity characteristic for maintaining the alignment device shape, and the attachment portion has a balance of a rigidity characteristic to maintain the relative position of the attachment portion 32 and the sighting structure 34 while having resilient properties sufficient to permit the attachment portion 32 to be resiliently snap-fitted onto the shaft 16 of the club 12. As will be explained below, the attachment portion 32 includes a contact member 36.

The contact member 36 is formed from a material having a first coefficient of friction against the material of the shaft 16 that is greater than a second coefficient of friction of the attachment portion 32 against the material of the shaft 16. The contact member 36 pressed against the shaft 16 creates a stiction condition or characteristic in which the frictional engagement of the contact member against the shaft prevents alignment device 10 from being set in motion relative to the shaft. This stiction characteristic can prevent unintended initiation of at least one of rotational movement, longitudinal movement, or both movements relative to the shaft 16 due to operation of the club 12. To create an intended movement of the alignment device 10, a force is applied to the alignment device to overcome the stiction force and initiate movement. Once the stiction force is overcome, the force used to maintain motion is typically lower. The force to initiate movement of the alignment device relative e to the shaft is typically greater than those transmitted by accelerations due to swinging the club or transmission of forces from a ball strike event. Thus, a golfer can position the alignment device 10 relative to the shaft 16 and its position will be maintained until the golfer manually repositions the alignment device. In one embodiment, the contact member 36 may be formed from a rubber compound, either natural or synthetic rubber, having a durometer in a range of about 60-80 on a Shore A durometer scale. Materials forming the main body and the attachment portion are desirably harder and may be scaled on a Shore D scale, Rockwell or Brinell hardness scale.

The main body 30 is generally elongated and can have any suitable cross-sectional shape for providing proper rigidity of the alignment device 10. In the embodiment shown, the main body 30 has a generally rectangular cross sectional shape. Preferably, the width of the main body that extends from the attachment portion 32 toward, and to, the sighting structure 34, as looking downwardly thereon, is less than, or more preferably substantially less than, the diameter of the shaft 16. This relatively small width is preferred so that the user does not view the main body 30 and is obstructed completely by the shaft 16. The main body 30 includes a first end 40 and a second end 42. The attachment portion 32 is disposed on the first end 40.

The attachment portion 32 is preferably shaped so as to provide a resilient means for mounting the alignment device 10 on the shaft 16 of the club 12. In the embodiment shown in FIGS. 2 and 3, the attachment portion 32 has a generally C-shape defined by a pair of arcuate retaining arms 50 and 52 extending outwardly from a web portion 54. The web portion 54 is disposed on the first end 40 of the main body 30. The retaining arms 50 and 52 converge towards one another to form a cavity 55. The terminal ends 56 and 58 of the arms 50 and 52, respectively, are spaced apart from one another, and preferably are greater than one half the circumference of the shaft. The retaining arms 50 and 52 define an inner diameter $D_1$ which is preferably less than the diameter $D_2$ of the shaft 16. To attach the alignment device 10 to the shaft 16, the arms 50 and 52 are lightly resiliently spread apart from one another while receiving the shaft 16 therebetween until the arms 50 and 52 surround the shaft 16. Since the width $D_1$ defined by the arms 50 and 52 is less than the diameter $D_2$ of the shaft 16, the arms 50 and 52 function as spring members frictionally holding the alignment device 10 onto the shaft 16.

Figure 6:
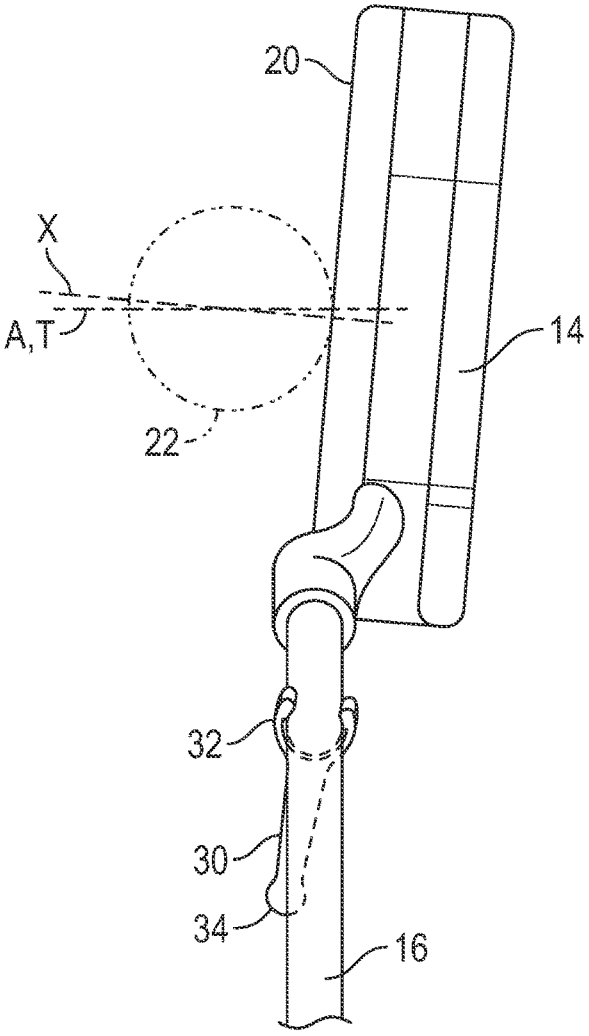
FIG. 6 is a partial plan view similar to FIG. 5, but with a misaligned club head illustrating that a portion of the sighting structure is visibly exposed.
Figure 7:
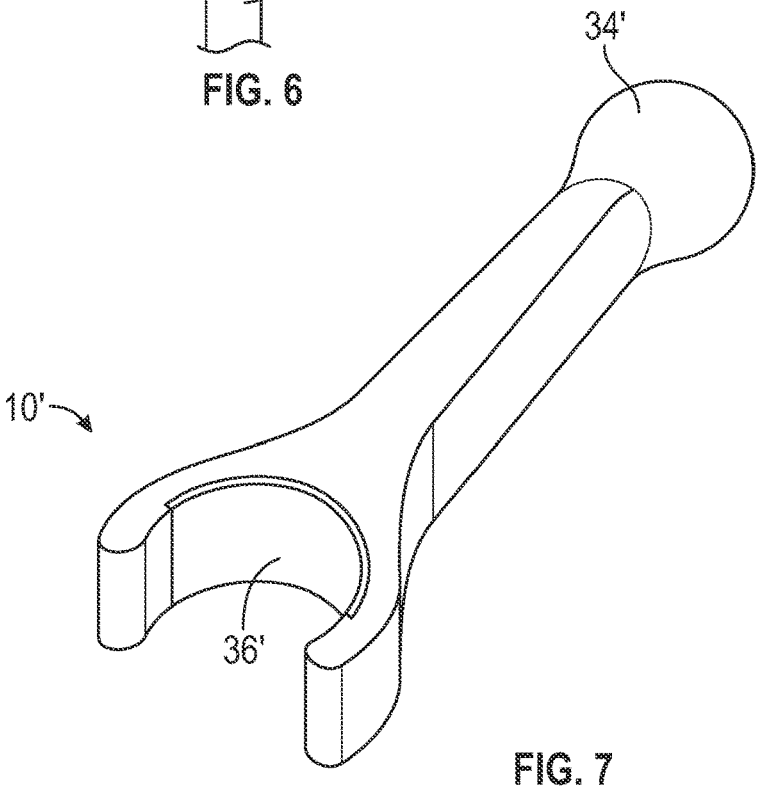
FIG. 7 is a perspective view of another example alignment device in which the sighting structure has a spherical shape.

The sighting structure 34 is disposed on the second end 42 of the body 30. The sighting structure 34 can have any suitable shape for assisting in aligning the alignment device 10 with the shaft 16 by the user, as will be described below. In the embodiment illustrated in FIGS. 1 through 6, the sighting structure 34 is shaped in the form of a generally vertically oriented cylinder. When viewed from above, the sighting structure 34 is generally viewed as a circle. It should be understood that the sighting structure 34 can have any suitable shape. For example, there is illustrated in FIG. 7 an alternate embodiment of an alignment device 10' having a sighting structure 34' having a spherical shape. The alignment device 10' utilizes a similar contact member 36' to maintain its relative position on the club shaft.

Figure 4:
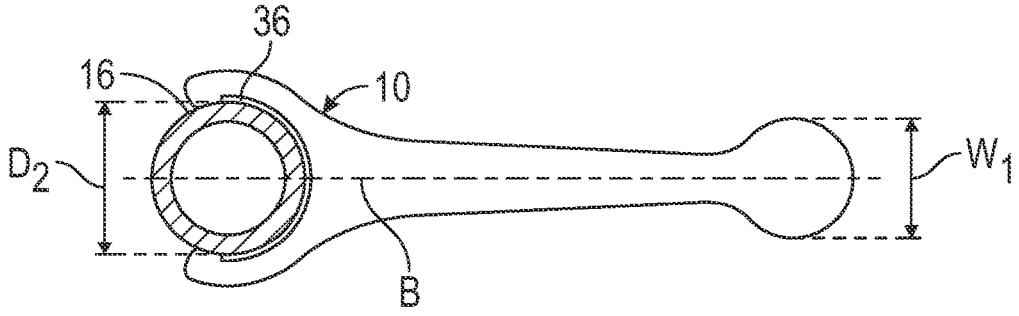
FIG. 4 is a plan view of the alignment device shown in FIGS. 1 through 3 with the club shaft shown in section.

Regardless of the shape of the sighting structure 34, the sighting structure 34 preferably has a width Wi equal to or less than the diameter $D_2$ of the shaft 16. The width Wi is defined as the width taken along a perpendicular viewing point relative to an axis B defined by the elongated body 30, as best shown in FIG. 4.

During the swing of the club 12, the shaft 16 is held by the user at an angle relative to the horizontal, as best shown in FIG. 1. Thus, the shaft 16 is not held exactly or near vertical. The alignment device 10 is preferably mounted on the shaft 16 of the club 12 at a lower portion thereof, as shown in FIG. 1. Thus, the alignment device 10 is positioned underneath the shaft 16 when viewed from above, as schematically indicated by an eye 60 of the user in FIG. 1. Thus, in a normal stance of a user of the club 12, the alignment device 10 is positioned underneath the shaft 16 as viewed from the position of the eye 60. Generally, even during the arcuate swing path of the club 12, the alignment device 10 is positioned underneath the shaft 16.

Figure 5:
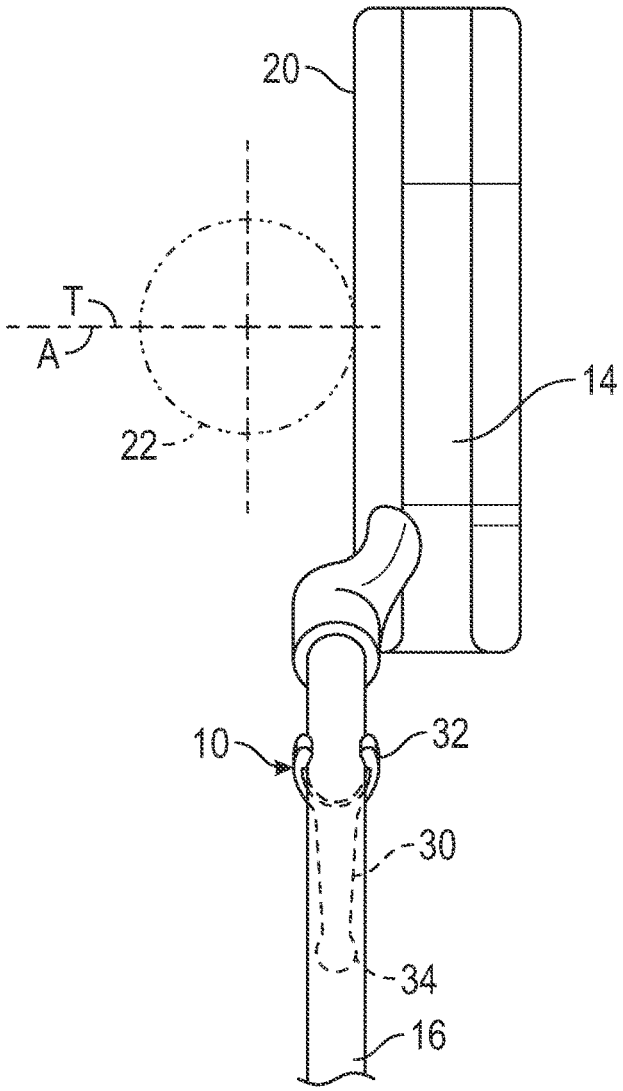
FIG. 5 is a partial plan view illustrating a properly positioned club head relative to a ball and intended travel direction with the sighting structure of the alignment device hidden by the shaft.

The alignment device 10 should first be properly positioned with respect to the striking face 20 of the club 12. In most situations, the user will chose to align the alignment device 10 such that the axis B as defined by the body 30 is generally parallel to the striking face 20, as best shown in FIG. 5. Once the alignment device 10 has been properly positioned relative to the shaft 16, the user will initially line up the shaft 16 such that the shaft 16 is generally perpendicular to an intended travel direction T of the ball, which is co-planar with the arcuate axis A. The user then rotates the shaft 16 to orient the striking face 20 perpendicularly with the axes A and T. To accomplish this, the alignment device 10 should be oriented completely underneath the shaft 16, as shown in FIG. 5, such that the edges of the sighting structure 34 cannot be seen by the eye 60 of the user. Thus, the user simply rotates the shaft 16 until the sighting structure 34 is hidden from view by the shaft 16.

Once the user has proper alignment of the club 12, the user then swings the club 12 in the arcuate path reassuring that just prior to impact with the ball (after the back swing and then forward swing) that the sighting structure 34 is hidden by the shaft 16. If the user discovers that the sighting structure 34 is not hidden, but is offset, such as shown in FIG. 6, this indicates that the ball will not travel in the intended travel direction but at a direction X which is perpendicular to the striking face 20. The user can then practice his or her swing until systematically, the user properly positions the club so that the sighting structure is hidden from view by the shaft 16. Thus, the alignment device 10 can be used as a practice aid to observe and correct improper swing arcs of the user.

However, it should be understood that the alignment device 10 may be positioned at any position the user so wishes. The alignment device 10 may be positioned offset relative to the striking face 20 or misaligned on purpose so as to compensate for the viewing angle of the user. Additionally, the user may choose to misalign the alignment device 10 because although the user properly aligns the striking face 20 during the beginning of the swing during initial line up, the user alters the position of the striking face during the back swing and upon contact with the ball 22.

Due to the frictional engagement of the contact member 36 to the shaft 16 via a clamping force applied by the attachment portion 32, the alignment device 10 maintains its set position until repositioned by the user. Once the initial frictional engagement or stiction characteristic is overcome, the alignment device may easily be rotated or shifted into a desired position.

Figure 8:
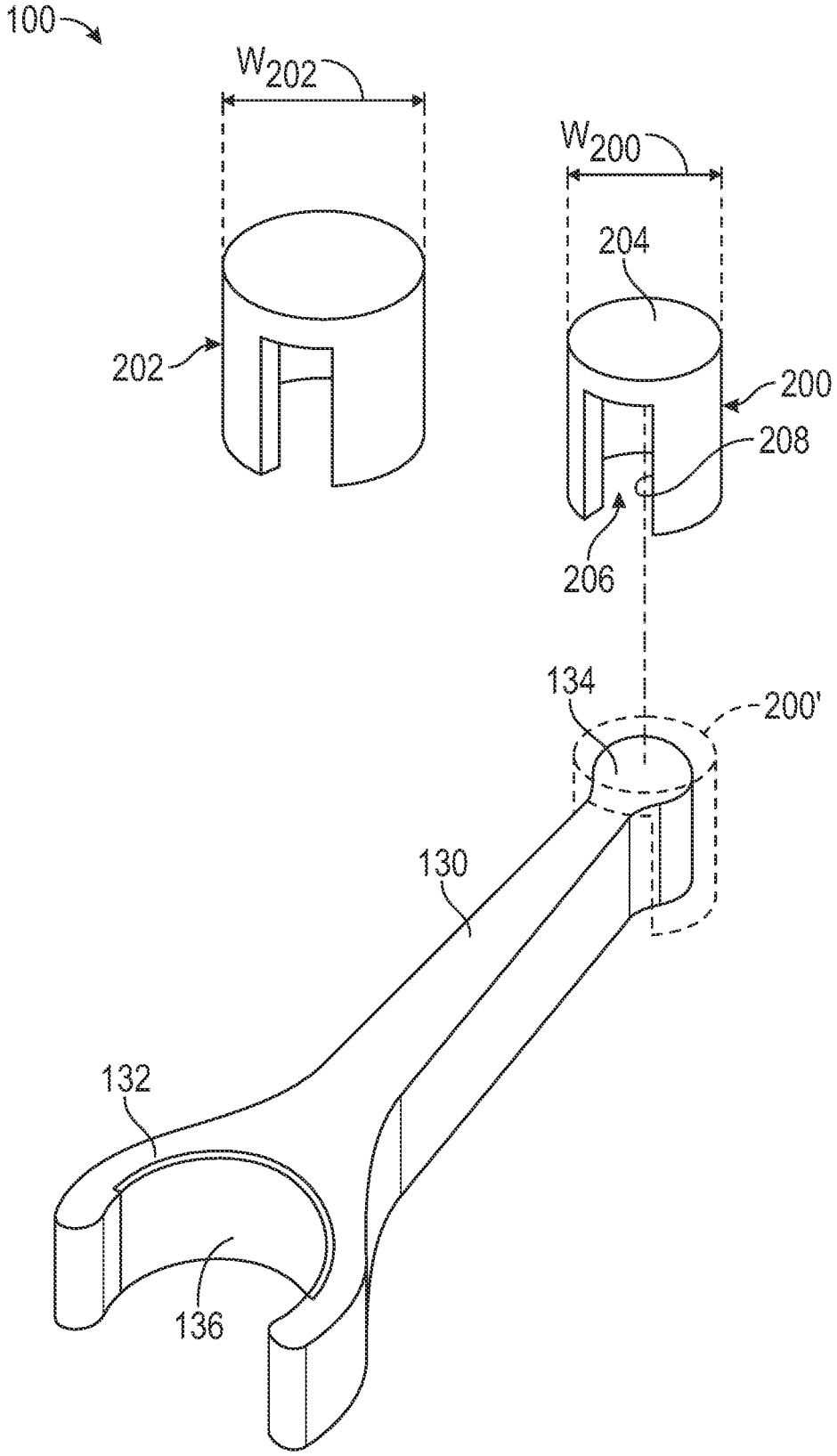
FIG. 8 is an exploded view of another example alignment device that includes one or more caps that can be removably mounted on the sighting structure to alter the visible width of the sighting structure.

FIG. 8 illustrates another example alignment device 100. The alignment device 100 is similar to the alignment device 10 illustrated in FIGS. 1 through 6 and described above, except as detailed below. The alignment device 100 includes a main body 130, an attachment portion 132, and a sighting structure 134. The attachment portion 132 includes a contact member 136, similar in material properties and stiction characteristic to contact member 36.

The alignment device 100 optionally can be included in a kit in which a plurality of caps, such as caps 200 and 202 shown in FIG. 8, may be used to cover the sighting structure 134, as shown by phantom lines 200'. Each cap in the plurality of caps 200, 202 preferably has different widths, such as widths $W_{200}$ and $W_{202}$ for the caps 200 and 202, respectively, for altering the overall visual width of the sighting structure. Thus, the alignment device 100 and the caps 200 and 202 can be packaged and sold as a kit in which the user can mount different caps onto the alignment device 100 for altering the visual width of the sighting structure underneath a shaft of a golf club. Thus, the width of the sighting structure 134 would have the smallest width.

The caps 200 and 202, or more of a plurality of caps, can have any suitable shape which accommodates the mounting of the cap to the sighting structure 134. Preferably, the caps are removably mounted on the sighting structure 134 by a frictional resilient engagement. In the illustrated embodiment of FIG. 8, the cap 200 has a generally hollow cylindrical shape having a capped top 204, an open bottom 206, and a slot 208. The slot 208 is formed in a portion of a cylindrical wall of the cap 200. The slot 208 extends upwardly from an edge of the open bottom 206. When mounted on the sighting structure 134, the slot 208 of the 200 receives a portion of the second end 142 of the body 130 to accommodate the second end, as shown by phantom lines 200'.

FIGS. 9 through 18 illustrate alignment devices that include a contact member for stabilizing the alignment device relative to a golf club. For example, the contact members described herein provide a mechanism for holding the alignment device in place during a swing. This can be accomplished using any suitable contact member, having any suitable structural arrangement, attached to an alignment device in any suitable orientation, and being formed of any suitable material. Examples of suitable contact members, structural arrangements for contact members, orientations to position a contact member on an alignment device, and materials considered suitable to form a contact member are described herein.

Figure 9:
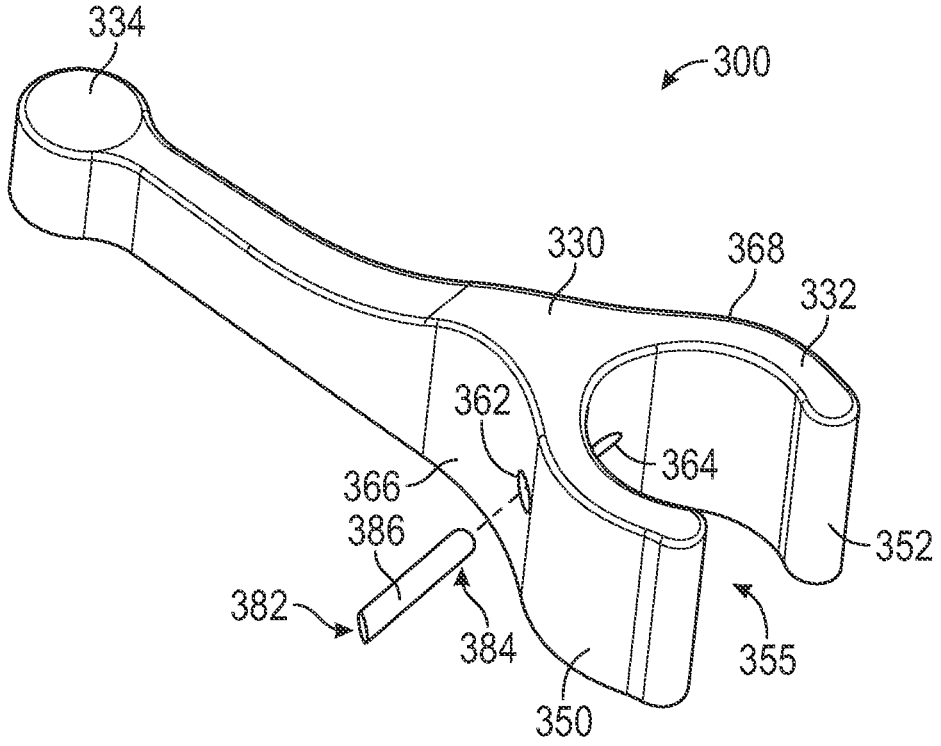
FIG. 9 is an exploded perspective view another example alignment device that includes a contact member that is radially tangent to a shaft of a golf club when the alignment device is attached to the shaft. The attachment portion has two retaining arms.
Figure 10:
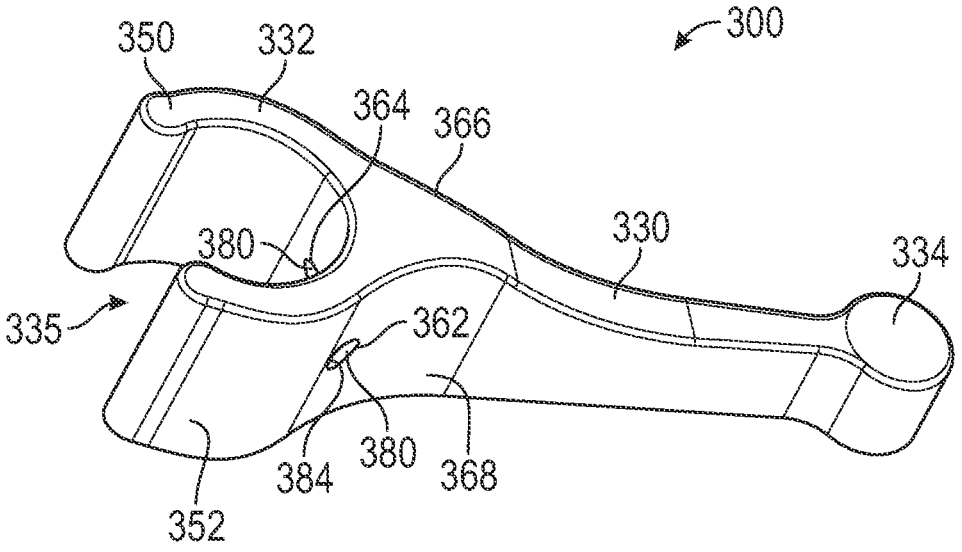
FIG. 10 is another perspective view of the alignment device shown in FIG. 9.

FIGS. 9 and 10 illustrate another example alignment device 300. The alignment device 300 is similar to the alignment device 10 illustrated in FIGS. 1 through 6 and described above, except as detailed below. The alignment device 300 includes a main body 330, an attachment portion 332, and a sighting structure 334 that extends from the attachment portion 332.

In the illustrated embodiment, the main body 330 is formed of a first material, defines a cavity 355, a passageway 362, and an opening 364 and the attachment portion 332 includes a contact member 380. The main body 330 has a first retaining arm 350 and a second retaining arm 352 that cooperatively define the cavity 355. An attachment portion of an alignment device can include any suitable number of retaining arms, such as one, more than one, two, more than two, a plurality, three, four, five, six, more than six, and any other number considered suitable for a particular embodiment.

The passageway 362 is disposed between the attachment portion 332 and the sighting structure 334, extends through the entire width of the main body 330, and is sized and configured to receive the contact member 380. The passageway 362 extends from a first side 366 to a second side 368 of the attachment portion 332 and to the opening 364. The opening 364 extends from the passageway 362 to the cavity 355 such that when a contact member 380 is disposed within the passageway 362, a portion of the contact member 380 extends into the cavity 355.

The contact member 380 is disposed within the passageway 362, the opening 364, and partially disposed within the cavity 355. The contact member 380 has a first end 382, a second end 384, and a main body 386, is disposed between the attachment portion 332 and the sighting structure 334, and is disposed between the first retaining arm 350 and the second retaining arm 352. The contact member 380 extends outwardly from the main body 330 of the attachment portion 332 into the cavity 355 and is radially tangent to a shaft of a golf club when the shaft is disposed within the cavity 355. During use, the contact member 380 contacts a shaft of a golf club disposed within the cavity 355 and maintains the position of the alignment device 300 relative to the golf club. The contact members described herein are used to stabilize an alignment device relative to a golf club during use. For example, the contact member 380 is configured to contact a shaft of a golf club in a plane perpendicular to a central axis of the shaft of the golf club. In the illustrated embodiment, the contact member 380 is an elongate member that is formed of a second material that is different than the first material.

A contact member can be formed of any suitable material and selection of a suitable material can be based on various considerations, such as the material that forms a main body of an alignment device and/or the amount of stiction or initial frictional engagement to be overcome to initiate movement. Examples of materials considered suitable to form a main body of an alignment device may include composite materials, plastic, aluminum, spring steel and other materials compressible between a golf club shaft and a main body of an alignment device. Various processes can be used to form the alignment devices described herein such as extrusion and co-extrusion processes, forging, casting, billet machining, or 3D printing. For example, it is desirable that an alignment device have a first coefficient of friction between a shaft of a golf club and a contact member that is greater than a second coefficient of friction between the shaft of the golf club and a main body of the alignment device. When the first coefficient of friction between the attachment portion 300, through the contact member 380, and the shaft of the golf club is greater than the second coefficient of friction, the force required to move the alignment device relative to the golf club is greater, which results in an alignment device that is stabilized during use. While the contact members described herein are shown as a separate component attached to a main body of an alignment device, alternative embodiments can include a main body of an alignment device and a contact member formed as a single, unitary component.

In the context of the alignment device and the attachment portion embodiments described herein, the various attachment portion embodiments create a clamping force acting against the shaft having at least a component that is generally perpendicular to the shaft surface. These perpendicular forces act on the various contact member embodiments to create a frictional force against the club shaft 16 that acts in a shear or tangential direction across the club shaft surface to resist motion in the rotational and/or longitudinal directions. A greater clamping force results in a greater frictional force and higher stiction characteristic. An increased stiction force results in a higher initiation load to start movement of the alignment device. The greater the frictional force, the higher the load becomes to maintain movement of the alignment device relative to the shaft after the stiction force is overcome.

Figure 11:
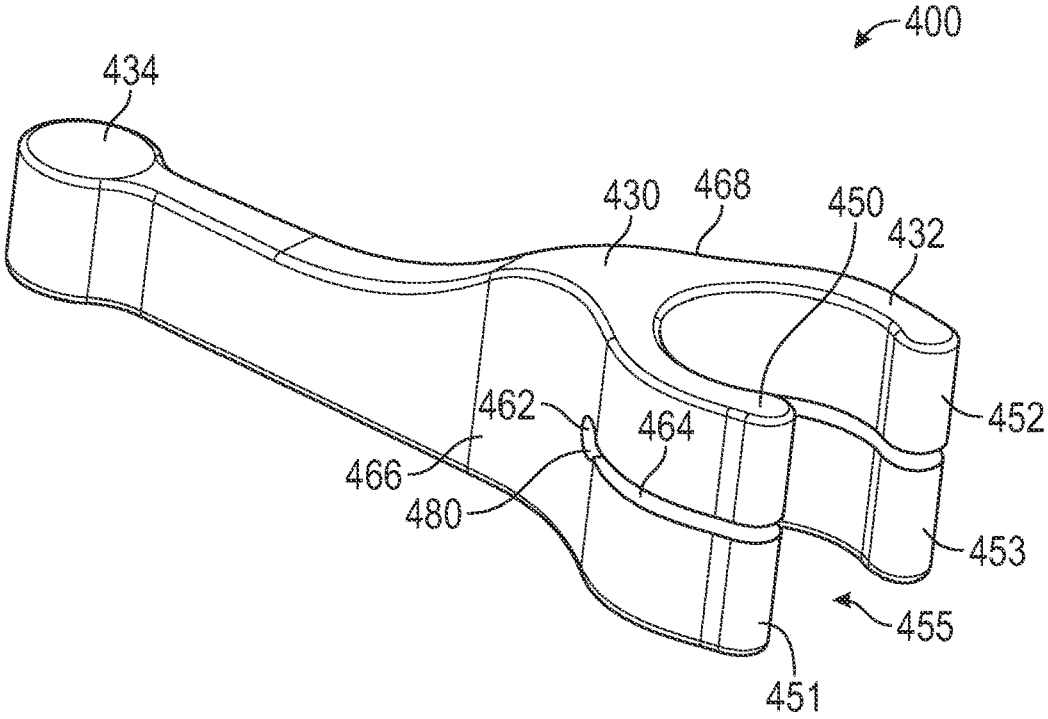
FIG. 11 is a perspective view another example alignment device that includes a contact member that is radially tangent to a shaft of a golf club when the alignment device is attached to the shaft. The attachment portion has four retaining arms.

FIG. 11 illustrates another example alignment device 400. The alignment device 400 is similar to the alignment device 300 illustrated in FIGS. 9 and 10 and described above, except as detailed below. The alignment device 400 includes a main body 430, an attachment portion 432, and a sighting structure 434 that extends from the attachment portion 432.

In the illustrated embodiment, the main body 430 is formed of a first material, defines a cavity 455, a first passageway 462, and a slot 464 and the attachment portion 432 includes a contact member 480. The main body 430 has a first retaining arm 450, a second retaining arm 452, a third retaining arm 451, and a fourth retaining arm 453 that cooperatively define the cavity 455 and the slot 464.

The passageway 462 is disposed between the attachment portion 432 and the sighting structure 434, extends through the entire width of the main body 430, and is sized and configured to receive the contact member 480. The passageway 462 opens into the cavity 455 creating an enlarged opening similar to opening 364 but that also connects to slot 464. However, alternative embodiments can include a passageway that only extends through a portion of a width of a main body. The passageway 462 extends from a first side 466 to a second side 468 of the attachment portion 432 and to the slot 464. The slot 464 extends from the passageway 462 to the terminal ends of the retaining arms 450, 451, 452, 453 such that when a contact member 480 is disposed within the passageway 462, a portion of the contact member 480 extends into the cavity 455. The slot 464 provides flexibility to the attachment portion allowing attachment to a shaft of a golf club with a reduced engagement force between the attachment portion and the shaft.

The contact member 480 is disposed within the passageway 462, the slot 464, and partially disposed within the cavity 455. The contact member 480 is disposed between the attachment portion 432 and the sighting structure 434. The contact member 480 extends outwardly from the main body 430 of the attachment portion 432 into the cavity 455 and is radially tangent to a shaft of a golf club when the shaft is disposed within the cavity 455. During use, the contact member 480 contacts a shaft of a golf club disposed within the cavity 455 and maintains the position of the alignment device 400 relative to the golf club. For example, the contact member 480 is configured to contact a shaft of a golf club in a plane perpendicular to a central axis of the shaft of the golf club. In the illustrated embodiment, the contact member 480 is an elongate member that is formed of a second material that is the same as the first material.

Figure 12:
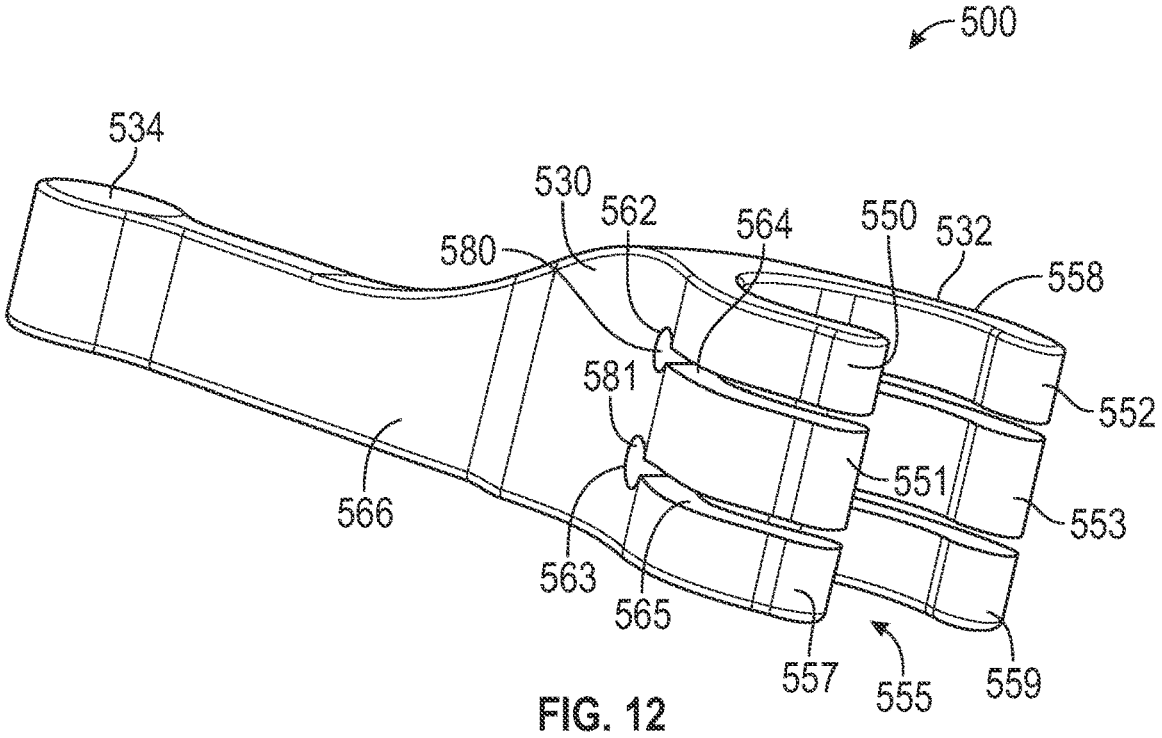
FIG. 12 is a perspective view another example alignment device that includes a plurality of contact members, each of which is radially tangent to a shaft of a golf club when the alignment device is attached to the shaft. The attachment portion has six retaining arms.

FIG. 12 illustrates another example alignment device 500. The alignment device 500 is similar to the alignment device 400 illustrated in FIG. 11 and described above, except as detailed below. The alignment device 500 includes a main body 530, an attachment portion 532, and a sighting structure 534 that extends from the attachment portion 532.

In the illustrated embodiment, the main body 530 defines a cavity 555, a first passageway 562, a second passageway 563, a first slot 564, a second slot 565, and the attachment portion 532 includes a first contact member 580 and a second contact member 581. The main body 530 has a first retaining arm 550, a second retaining arm 552, a third retaining arm 551, a fourth retaining arm 553, a fifth retaining arm 557, and a sixth retaining arm 559 that cooperatively define the cavity 555. The first, second, third, and fourth retaining arms 550, 552, 551, 553 cooperatively define the first a lot 564 and the third, fourth, fifth, and sixth retaining arms 551, 553, 557, 559 cooperatively define the second slot 565.

Each of the first passageway 562 and the second passageway 563 is disposed between the attachment portion 532 and the sighting structure 534, extends through the entire width of the main body 530, and is sized and configured to receive a contact member 580, 581. The first passageway 562 extends from a first side 566 to a second side 568 of the attachment portion 532 and to the first slot 564. The second passageway 563 extends from the first side 566 to the second side 568 of the attachment portion 532 and to the second slot 565. The first slot 564 extends from the first passageway 562 to the terminal ends of the retaining arms 550, 551, 552, 553 such that when a first contact member 580 is disposed within the first passageway 562, a portion of the first contact member 580 extends into the cavity 555. The second slot 565 extends from the second passageway 563 to the terminal ends of the retaining arms 551, 533, 557, 559 such that when a second contact member 581 is disposed within the second passageway 563, a portion of the second contact member 581 extends into the cavity 555. The first slot 564 and the second slot 565 provide flexibility to the attachment portion allowing for attachment of the alignment device 500 to a shaft of a golf club.

The first contact member 580 is disposed within the first passageway 562, the first slot 564, and partially disposed within the cavity 555. The first contact member 580 is disposed between the attachment portion 532 and the sighting structure 534. The first contact member 580 extends outwardly from the main body 530 of the attachment portion 532 into the cavity 555 and is radially tangent to a shaft of a golf club when the shaft is disposed within the cavity 555. During use, the first contact member 580 contacts a shaft of a golf club disposed within the cavity 555 and maintains the position of the alignment device 500 relative to the golf club. For example, the first contact member 580 is configured to contact a shaft of a golf club in a plane perpendicular to a central axis of the shaft of the golf club.

The second contact member 581 is disposed within the second passageway 563, the second slot 565, and partially disposed within the cavity 555. The second contact member 581 is disposed between the attachment portion 532 and the sighting structure 534. The second contact member 581 extends outwardly from the main body 530 of the attachment portion 532 into the cavity 555 and is radially tangent to a shaft of a golf club when the shaft is disposed within the cavity 555. During use, the second contact member 581 contacts a shaft of a golf club disposed within the cavity 555 and maintains the position of the alignment device 500 relative to the golf club. For example, the second contact member 581 is configured to contact a shaft of a golf club in a plane perpendicular to a central axis of the shaft of the golf club.

Figure 13:
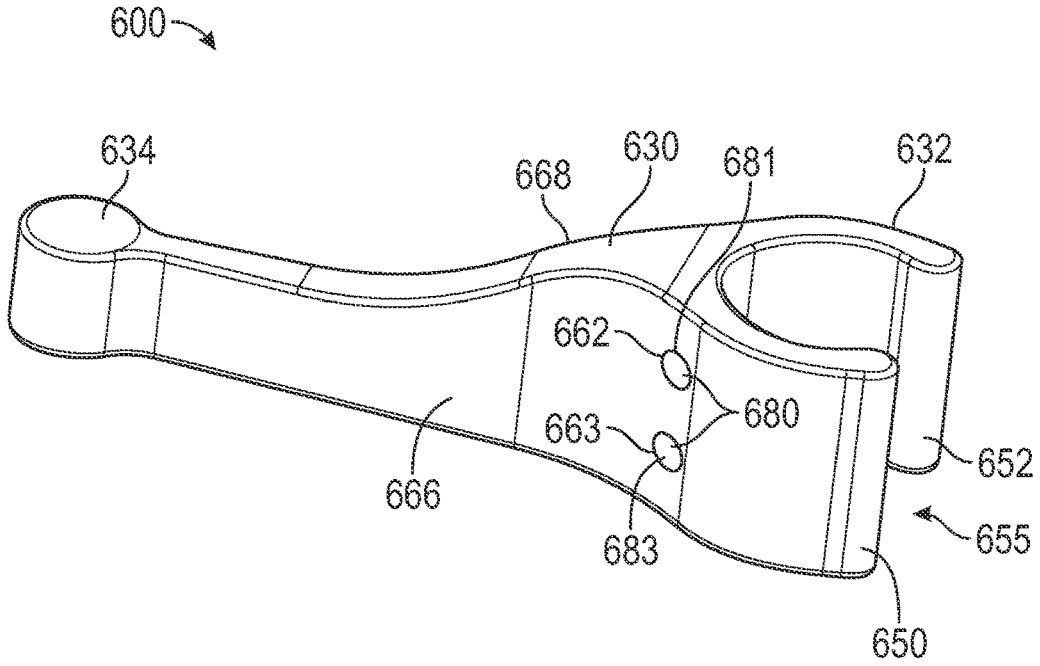
FIG. 13 is a perspective view another example alignment device that includes a plurality of contact members, each of which is radially tangent to a shaft of a golf club when the alignment device is attached to the shaft. The attachment portion has two retaining arms.
Figure 14:
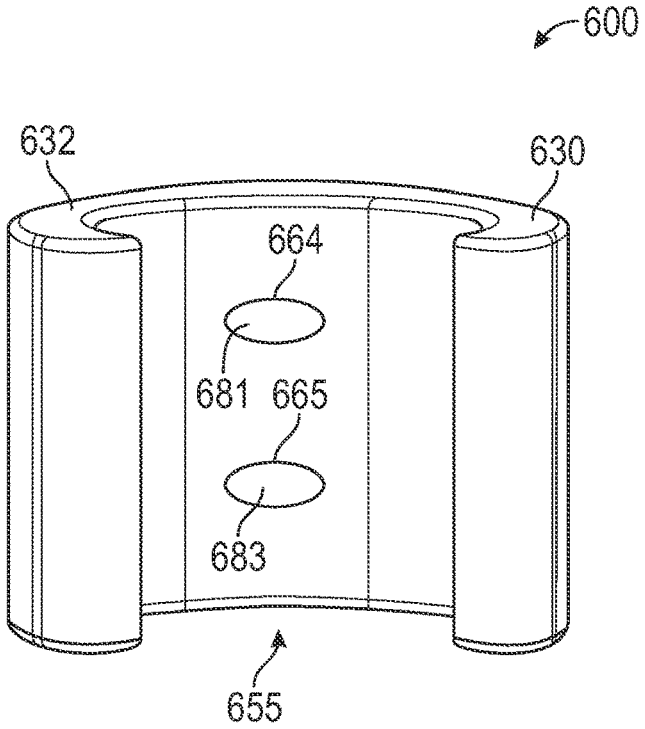
FIG. 14 is another perspective view of the alignment device shown in FIG. 13.

FIGS. 13 and 14 illustrate another example alignment device 600. The alignment device 600 is similar to the alignment device 300 illustrated in FIGS. 9 and 10 and described above, except as detailed below. The alignment device 600 includes a main body 630, an attachment portion 632, and a sighting structure 634 that extends from the attachment portion 632.

In the illustrated embodiment, the main body 630 defines a cavity 655, a first passageway 662, a second passageway 663, a first opening 664, a second opening 665, and the attachment portion 632 includes a plurality of contact members 680, which includes a first contact member 681 and a second contact member 683. The main body 630 has a first retaining arm 650 and a second retaining arm 652 that cooperatively define the cavity 655. Any suitable number of passageways and openings can be defined by a main body and any suitable number of contact members can be included in an attachment member. Examples of numbers of passageways and openings considered suitable for a main body to define include one, two, a plurality, three, four, more than four, and any other number considered suitable for a particular embodiment. Examples of numbers of contact members considered suitable to include in an attachment member include one, two, a plurality, three, four, more than four, and any other number considered suitable for a particular embodiment.

Each of the first passageway 662 and the second passageway 663 is disposed between the attachment portion 632 and the sighting structure 634, extends through the entire width of the main body 630, and is sized and configured to receive a contact member 681, 683. The first passageway 662 extends from a first side 666 to a second side 668 of the attachment portion 632 and to the first opening 664. The second passageway 663 extends from a first side 666 to a second side 668 of the attachment portion 632 and to the second opening 665. The first opening 664 extends from the first passageway 662 to the cavity 655 such that when the first contact member 681 is disposed within the first passageway 662, a portion of the first contact member 681 extends into the cavity 655. The second opening 665 extends from the second passageway 663 to the cavity 655 such that when the second contact member 683 is disposed within the second passageway 663, a portion of the second contact member 683 extends into the cavity 655.

The first contact member 681 is disposed within the first passageway 662, the first opening 664, and partially disposed within the cavity 655. The second contact member 683 is disposed within the second passageway 663, the second opening 665, and partially disposed within the cavity 655. Each of the first contact member 681 and the second contact member 683 is disposed between the attachment portion 632 and the sighting structure 634. Each of the first contact member 681 and the second contact member 683 extends outwardly from the main body 630 of the attachment portion 632 into the cavity 655 and is radially tangent to a shaft of a golf club when the shaft is disposed within the cavity 655. During use, each of the first contact member 681 and the second contact member 683 contacts a shaft of a golf club disposed within the cavity 655 and maintains the position of the alignment device 600 relative to the golf club. For example, the first and second contact members 681, 683 are configured to contact a shaft of a golf club in a plane perpendicular to a central axis of the shaft of the golf club.

Figure 15:
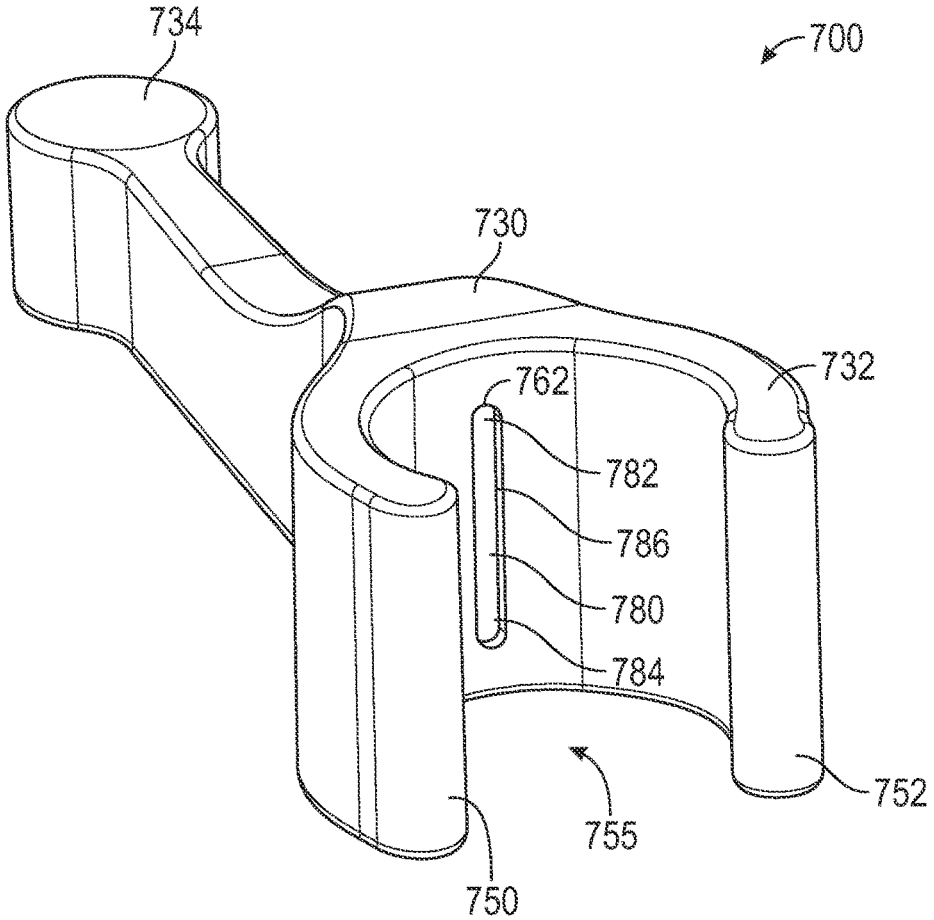
FIG. 15 is a perspective view another example alignment device that includes a contact member that is longitudinally tangent to a shaft of a golf club when the alignment device is attached to the shaft. The attachment portion has two retaining arms.

FIG. 15 illustrates another example alignment device 700. The alignment device 700 is similar to the alignment device 300 illustrated in FIGS. 9 and 10 and described above, except as detailed below. The alignment device 700 includes a main body 730, an attachment portion 732, and a sighting structure 734 that extends from the attachment portion 732.

In the illustrated embodiment, the main body 730 defines a cavity 755, a recess 762 and the attachment portion 732 includes a contact member 780 disposed within the recess 762. The main body 730 has a first retaining arm 750 and a second retaining arm 752 that cooperatively define the cavity 755.

The recess 762 is disposed between the first retaining arm 750 and the second retaining arm 752 and extends from the main body 730 to the cavity 755. The recess 762 is elongated and is sized and configured to receive a portion of the contact member 780. The recess 764 has a depth such that when a contact member 780 is disposed within the recess 762 a portion of the contact member 780 extends into the cavity 755.

The contact member 780 is an elongate member, is disposed within the recess 762, and partially disposed within the cavity 755. The contact member 780 has a first end 782, a second end 784, and a main body 786 and is disposed between the first retaining arm 750 and the second retaining arm 752. The contact member 780 extends outwardly from the main body 730 of the attachment portion 732 into the cavity 755 and is longitudinally tangent to a shaft of a golf club when the shaft is disposed within the cavity 755. During use, the contact member 780 contacts a shaft of a golf club disposed within the cavity 755 and maintains the position of the alignment device 700 relative to the golf club. For example, the contact member 780 is configured to contact a shaft of a golf club in a plane parallel to a central axis of the shaft of the golf club.

Figure 16:
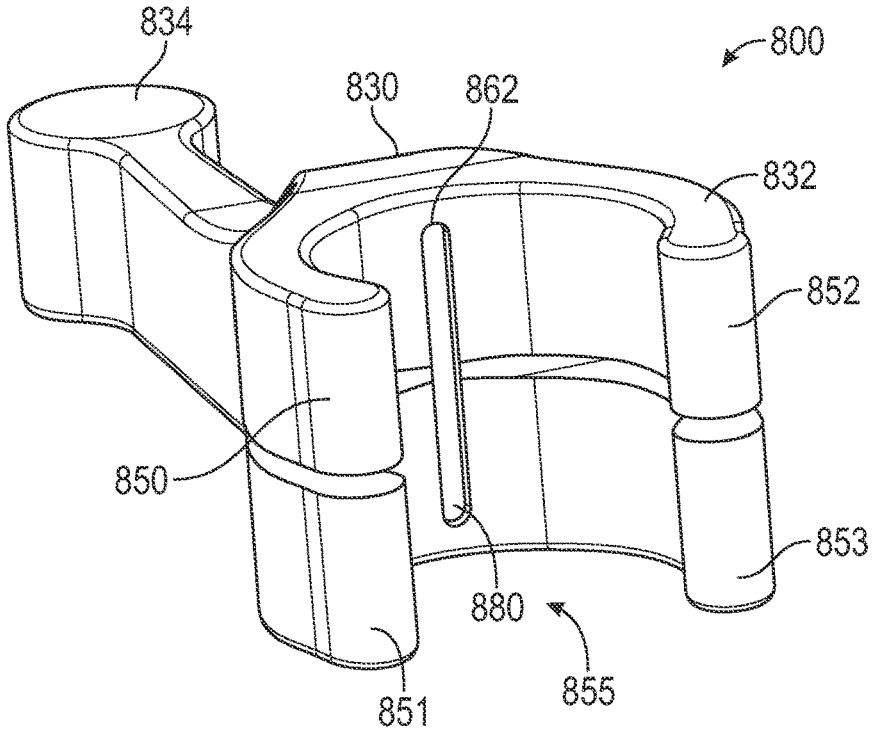
FIG. 16 is a perspective view another example alignment device that includes a contact member that is longitudinally tangent to a shaft of a golf club when the alignment device is attached to the shaft. The attachment portion has four retaining arms.

FIG. 16 illustrates another example alignment device 800. The alignment device 800 is similar to the alignment device 700 illustrated in FIG. 15 and described above, except as detailed below. The alignment device 800 includes a main body 830, an attachment portion 832, and a sighting structure 834 that extends from the attachment portion 832.

In the illustrated embodiment, the main body 830 defines a cavity 855, a recess 862 and the attachment portion 832 includes a contact member 880 disposed within the recess 862. The main body 830 has a first retaining arm 850, a second retaining arm 852, a third retaining arm 851, a fourth retaining arm 853 that cooperatively define the cavity 855.

The recess 862 is disposed between the first retaining arm 850 and the second retaining arm 852, between the third retaining arm 851 and the fourth retaining arm 853, and extends from the main body 830 to the cavity 855. The recess 862 is elongated and is sized and configured to receive a portion of the contact member 880. The recess 864 has a depth such that when a contact member 880 is disposed within the recess 862 a portion of the contact member 880 extends into the cavity 855.

The contact member 880 is an elongate member, is disposed within the recess 862, and partially disposed within the cavity 855. The contact member 880 is disposed between the first retaining arm 850 and the second retaining arm 852 and between the third retaining arm 851 and the fourth retaining arm 853. The contact member 880 extends outwardly from the main body 830 of the attachment portion 832 into the cavity 855 and is longitudinally tangent to a shaft of a golf club when the shaft is disposed within the cavity 855.

Figure 17:
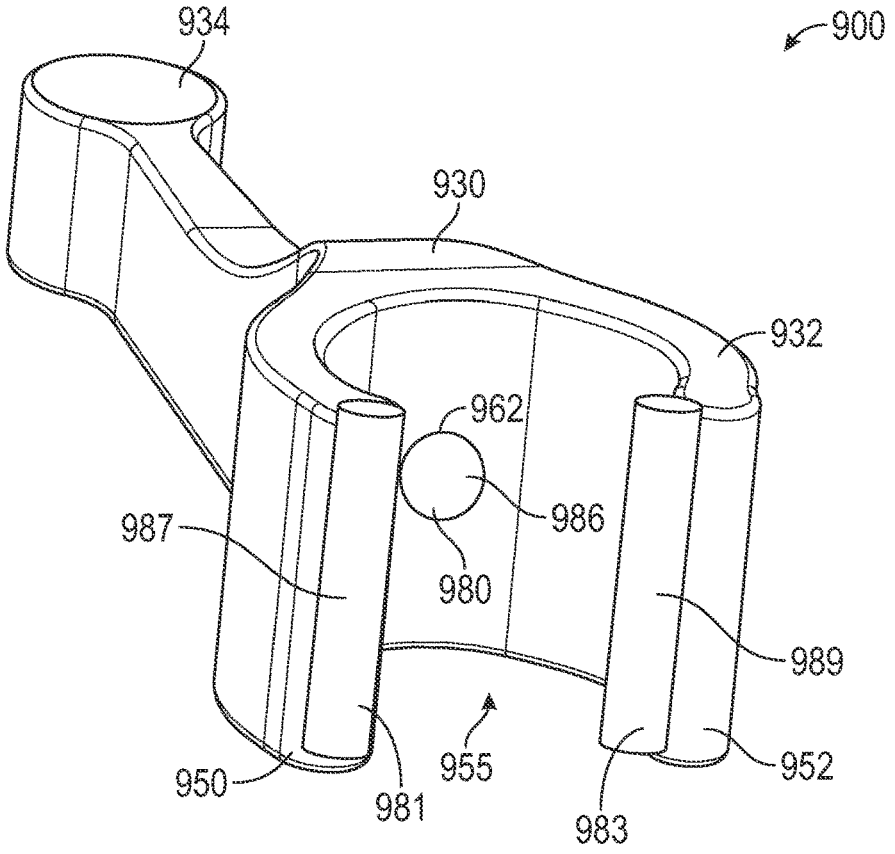
FIG. 17 is a perspective view another example alignment device that includes a first contact member that is perpendicularly tangent to a shaft of a golf club when the alignment device is attached to the shaft and second and third contact members that are longitudinally tangent to the shaft when the alignment device is attached to the shaft. The attachment portion has two retaining arms.

FIG. 17 illustrates another example alignment device 900. The alignment device 900 is similar to the alignment device 700 illustrated in FIG. 15 and described above, except as detailed below. The alignment device 900 includes a main body 930, an attachment portion 932, and a sighting structure 934 that extends from the attachment portion 932.

In the illustrated embodiment, the main body 930 defines a cavity 955 and a recess 962. The attachment portion 932 includes a first contact member 980 disposed within the recess 962, a second contact member 981 disposed on the terminal end of the first retaining arm 950, and a third contact member 983 on the terminal end of the second retaining arm 952. The first retaining arm 950 and the second retaining arm 952 cooperatively define the cavity 955.

The recess 962 is disposed between the first retaining arm 950 and the second retaining arm 952 and extends from the main body 930 to the cavity 955. The recess 962 is sized and configured to receive a portion of the first contact member 980. The recess 964 has a depth such that when the first contact member 980 is disposed within the recess 962 a portion of the first contact member 980 extends into the cavity 955.

The first contact member 980 is disposed within the recess 962 and is partially disposed within the cavity 955. The first contact member 980 has a main body 986 and is disposed between the first retaining arm 950 and the second retaining arm 952. The first contact member 980 extends outwardly from the main body 930 of the attachment portion 932 into the cavity 955 and is perpendicularly tangent to a shaft of a golf club when the shaft is disposed within the cavity 955. During use, the first contact member 980 contacts a shaft of a golf club disposed within the cavity 955 and maintains the position of the alignment device 900 relative to the golf club. For example, the first contact member 980 is configured to contact a shaft of a golf club in a plane perpendicular to a central axis of the shaft of the golf club.

The second contact member 981 is attached to the terminal end of the first retaining arm 950 and is partially disposed within the cavity 955. The second contact member 981 has a main body 987 and is disposed between the first retaining arm 950 and the second retaining arm 952. The second contact member 981 extends outwardly from the main body 930 of the attachment portion 932 into the cavity 955 and is longitudinally tangent to a shaft of a golf club when the shaft is disposed within the cavity 955. During use, the second contact member 981 contacts a shaft of a golf club disposed within the cavity 955 and maintains the position of the alignment device 900 relative to the golf club. For example, the second contact member 981 is configured to contact a shaft of a golf club in a plane parallel to a central axis of the shaft of the golf club.

The third contact member 983 is attached to the terminal end of the second retaining arm 952 and is partially disposed within the cavity 955. The third contact member 983 has a main body 989 and is disposed between the first retaining arm 950 and the second retaining arm 952. The third contact member 983 extends outwardly from the main body 930 of the attachment portion 932 into the cavity 955 and is longitudinally tangent to a shaft of a golf club when the shaft is disposed within the cavity 955. During use, the third contact member 983 contacts a shaft of a golf club disposed within the cavity 955 and maintains the position of the alignment device 900 relative to the golf club. For example, the third contact member 983 is configured to contact a shaft of a golf club in a plane parallel to a central axis of the shaft of the golf club.

Figure 18:
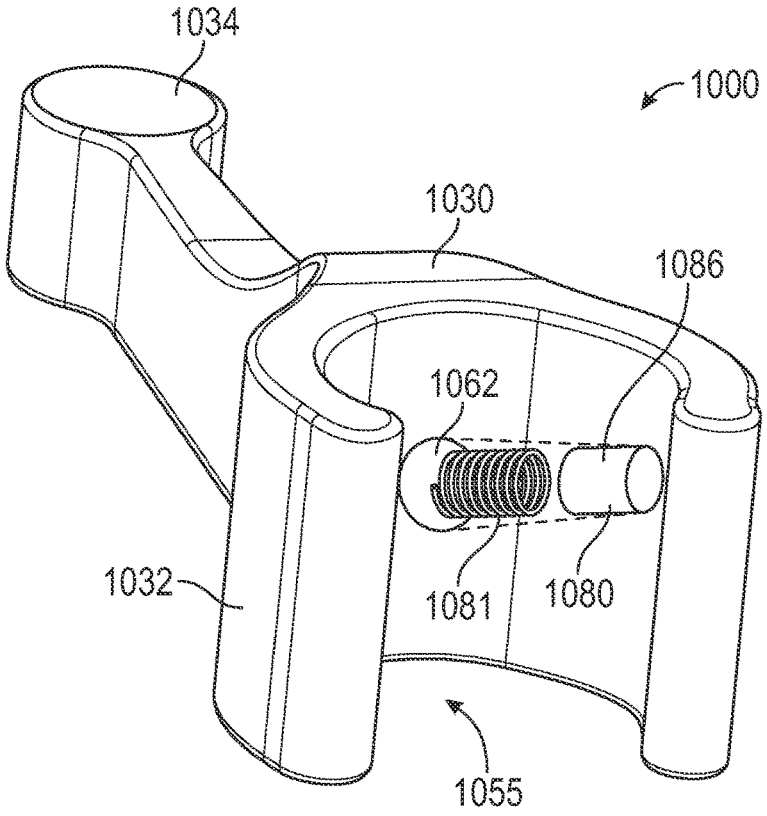
FIG. 18 is an exploded perspective view another example alignment device that includes a contact member that is perpendicularly tangent to a shaft of a golf club when the alignment device is attached to the shaft. The attachment portion has two retaining arms and the contact member is moveable between a resting position and a locking position.

FIG. 18 illustrates another example alignment device 1000. The alignment device 1000 is similar to the alignment device 900 illustrated in FIG. 17 and described above, except as detailed below. The alignment device 1000 includes a main body 1030, an attachment portion 1032, and a sighting structure 1034 that extends from the attachment portion 1032.

In the illustrated embodiment, the main body 1030 defines a cavity 1055 and a recess 1062 and the attachment portion 1032 includes a contact member 1080 and a resilient member 1081, illustrated as a coil spring, disposed within the recess 1062. Though shown as a coil spring, the resilient member 1081 is configured to generate a second spring rate and an associated normal force or perpendicular force loading the contact member 1080 against the shaft surface. Thus, the spring 1081 may be tuned to provide a greater frictional force by the contact member rather than the spring rate associated with compression of the contact member alone.

The recess 1062 is disposed between the first retaining arm 1050 and the second retaining arm 1052 and extends from the main body 1030 to the cavity 1055. The recess 1062 is sized and configured to receive a portion of the contact member 1080 and the spring 1081. The recess 1062 has a depth such that when the contact member 1080 and the spring are disposed within the recess 1062, a portion of the contact member 1080 extends into the cavity 1055.

The contact member 1080 and the spring 1081 are disposed within the recess 1062 and the contact member is partially disposed within the cavity 1055. The contact member 1080 has a main body 1086 and is disposed between the first retaining arm 1050 and the second retaining arm 1052. The contact member 1080 is moveable by the spring 1081 between a resting position and a locking position. The contact member 1080 is disposed a first distance from the sighting structure 1034 in the resting position and a second distance from the sighting structure 1034 in the locking position. The second distance is less than the first distance. The contact member 1080 is in the resting position when the cavity 1055 is empty and does not contain a shaft of a golf club. The contact member 1080 is in the locking position when a shaft of a golf club is disposed within the cavity 1055. The spring 1081 is used to apply a perpendicular force between the contact member 1080 and a shaft of a golf club by compressing the contact member 1080 onto the shaft.

The contact member 1080 extends outwardly from the main body 1030 of the attachment portion 1032 into the cavity 1055 and is perpendicularly tangent to a shaft of a golf club when the shaft is disposed within the cavity 1055. During use, the contact member 1080 contacts a shaft of a golf club disposed within the cavity 1055 and maintains the position of the alignment device 1000 relative to the golf club. For example, the first contact member 1080 is configured to contact a shaft of a golf club in a plane perpendicular to a central axis of the shaft of the golf club.

Those with ordinary skill in the art will appreciate that various modifications and alternatives for the described and illustrated embodiments can be developed in light of the overall teachings of the disclosure, and that the various elements and features of one example described and illustrated herein can be combined with various elements and features of another example without departing from the scope of the invention. Accordingly, the particular arrangement of elements disclosed herein have been selected by the inventor(s) simply to describe and illustrate examples of the invention and are not intended to limit the scope of the invention or its protection, which is to be given the full breadth of the appended claims and any and all equivalents thereof.

What is claimed is:

1. An alignment device for a golf club having a shaft, the alignment device comprising:

an attachment portion having a main body and a contact member, the main body formed of a first material and having a first retaining arm and a second retaining arm defining a cavity configured to receive the shaft, the main body having a passageway that extends into the cavity and defines an opening, the contact member formed of a second material that is different than the first material and provides a higher coefficient of friction against the shaft than the first material, the contact member extending through the passageway and a portion of the contact member extending from the opening toward the shaft and disposed between the first retaining arm and the second retaining arm; and a sighting structure extending from the attachment portion.

2. The alignment device of claim 1, wherein the first and second retaining arms resiliently engage the shaft onto the contact member.

3. The alignment device of claim 1, wherein the contact member is radially tangent to the shaft.

4. The alignment device of claim 1, wherein the contact member second material provides a stiction characteristic that maintains the position of the alignment device against the shaft.

5. The alignment device of claim 1, wherein the contact member second material is one of a natural rubber compound or a synthetic rubber compound and the main body first material is a plastic material.

6. The alignment device of claim 1, wherein the contact member second material has a durometer in a range of about 60 to about 80 on a Shore A durometer scale.

7. The alignment device of claim 1, wherein the contact member is an elongate member.

8. The alignment device of claim 1, wherein the main body defines more than two retaining arms.

9. The alignment device of claim 1, wherein the main body defines four retaining arms and the passageway are two passageways that extend into the cavity and define two openings.

10. The alignment device of claim 1, wherein the main body defines six retaining arms.

11. The alignment device of claim 1, wherein the contact member comprises a plurality of contact members.

12. The alignment device of claim 11, wherein each contact member of the plurality of contact members is disposed at a location between the attachment portion and the sighting structure.

13. The alignment device of claim 1, further comprising a golf club having a shaft, the shaft having an end and a head extending from the end of the shaft in a first direction;

wherein the attachment portion is attached to the shaft; and wherein the sighting structure extends from the attachment portion in a second direction that is generally opposite to the first direction.

14. The alignment device of claim 13, wherein the sighting structure is hidden by the shaft when viewed by a user gripping the golf club to address a ball.

15. A golf club and alignment device comprising:

a golf club having a shaft, the shaft having an end and a head extending from the end of the shaft in a first direction; and an alignment device comprising:

an attachment portion attached to the shaft and having a main body and a contact member, the main body formed of a first material and defining a first retaining arm and a second retaining arm, the first and second retaining arms cooperatively defining a cavity configured to receive the shaft and having a recess configured to retain the contact member, the contact member formed of a second material having a higher coefficient of friction against the shaft than the first material; and a sighting structure extending from the attachment portion, the alignment device being rotatable about the shaft against the higher coefficient of friction from a second direction to the first direction.

16. The golf club and alignment device of claim 15, wherein the contact member is longitudinally tangent to the shaft.

17. The golf club and alignment device of claim 15, wherein the second material is one of a natural rubber compound or a synthetic rubber compound having a durometer in a range of about 60 to about 80 on a Shore A durometer scale and the main body first material is a plastic material.

18. The golf club and alignment device of claim 15, wherein the recess orients the contact member to extend into the cavity and be resiliently compressed against the shaft by the first and second retaining arms.

19. The golf club and alignment device of claim 15, wherein the recess is an aperture formed into the attachment portion and supports a resilient member acting on the contact member to provide a second contact force against the shaft.

20. A golf club and alignment device comprising:

a golf club having a shaft, the shaft having an end and a head extending from the end of the shaft in a first direction;

an alignment device comprising:

an attachment portion attached to the shaft and having a main body and a contact member, the main body formed of a first material and defining a first retaining arm and a second retaining arm, the first and second retaining arms cooperatively defining a cavity that encircles more than half of a circumference of the shaft, the main body having one of a passageway defining an opening in the cavity or a recess that communicates with the cavity, the passageway or the recess supporting the contact member, the contact member formed of a second material configured as one of a natural rubber compound or a synthetic rubber compound having a higher coefficient against the shaft than the first material, the contact member extending outwardly from the main body into the cavity, the first and second retaining arms creating a resilient clamping force applied to the contact member against the shaft that generates a resistance to rotation of the alignment device; and a sighting structure.

* * * * *